US009967641B2

(12) United States Patent
Koch et al.

(10) Patent No.: US 9,967,641 B2
(45) Date of Patent: May 8, 2018

(54) MICROPHONE SYSTEM

(75) Inventors: Hartwig Koch, Hildesheim (DE); Holger Kiehne, Peine (DE); Florian Klingler, Munich (DE); Frank Hofmann, Hildesheim (DE); Gerald Spreitz, Laatzen (DE); Sascha Jakoblew, Hildesheim (DE); Radu Circa, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 490 days.

(21) Appl. No.: 13/508,569

(22) PCT Filed: Sep. 22, 2010

(86) PCT No.: PCT/EP2010/063943

§ 371 (c)(1),
(2), (4) Date: Jul. 24, 2012

(87) PCT Pub. No.: WO2011/054593

PCT Pub. Date: May 12, 2011

(65) Prior Publication Data

US 2012/0281851 A1 Nov. 8, 2012

(30) Foreign Application Priority Data

Nov. 9, 2009 (DE) ..... 10 2009 052 298

(51) Int. Cl.
*H04R 1/04* (2006.01)
*H04S 7/00* (2006.01)

(52) U.S. Cl.
CPC ..... *H04R 1/04* (2013.01); *H04R 2227/003* (2013.01); *H04R 2420/07* (2013.01); *H04R 2430/01* (2013.01); *H04S 7/307* (2013.01)

(58) Field of Classification Search
CPC . H04R 1/00; H04R 1/083; H04R 1/04; H04R 2227/003; H04R 2420/07; H04R 3/005
(Continued)

(56) References Cited

U.S. PATENT DOCUMENTS 6,025,553 A * 2/2000 Lee ..... G10H 1/365 84/602
2002/0042282 A1 4/2002 Haupt
(Continued)

FOREIGN PATENT DOCUMENTS

DE 202006002942 7/2007
EP 0633520 1/1995
(Continued)

OTHER PUBLICATIONS

PCT/EP2010/063943 International Search Report dated Dec. 17, 2010 (Translation and Original, 4 pages).

*Primary Examiner* — Duc Nguyen
*Assistant Examiner* — Yogeshkumar Patel
(74) *Attorney, Agent, or Firm* — Michael Best & Friedrich LLP

(57) ABSTRACT

The invention relates to a microphone system (1) having a microphone module (2) and having a base station (3), wherein the microphone system (1) is designed to wirelessly transfer audio information (5) and additional information (6) from the microphone module (2) to the base station (3), wherein the microphone system (1), in particular the microphone module (2) is designed to transfer the additional information (5) and the audio information (6) via a common channel and/or in a common data stream.

19 Claims, 1 Drawing Sheet

(58) Field of Classification Search
USPC ..... 381/77; 455/556.1, 453.1
See application file for complete search history.

(56) References Cited

U.S. PATENT DOCUMENTS

| | | | | |
|---|---|---|---|---|
| 2003/0087667 | A1* | 5/2003 | Taniguchi | H04R 1/083 455/556.1 |
| 2004/0137929 | A1* | 7/2004 | Jones | G01S 5/30 455/517 |
| 2007/0242834 | A1* | 10/2007 | Coutinho | G10K 11/1788 381/71.8 |
| 2010/0119099 | A1 | 5/2010 | Haupt et al. | |
| 2010/0290638 | A1* | 11/2010 | Heineman | H04H 60/04 381/77 |

FOREIGN PATENT DOCUMENTS

| | | | |
|---|---|---|---|
| EP | 0865225 | | 9/1998 |
| EP | 2207273 | A1 * | 4/2009 |
| WO | 0167315 | | 9/2001 |

* cited by examiner

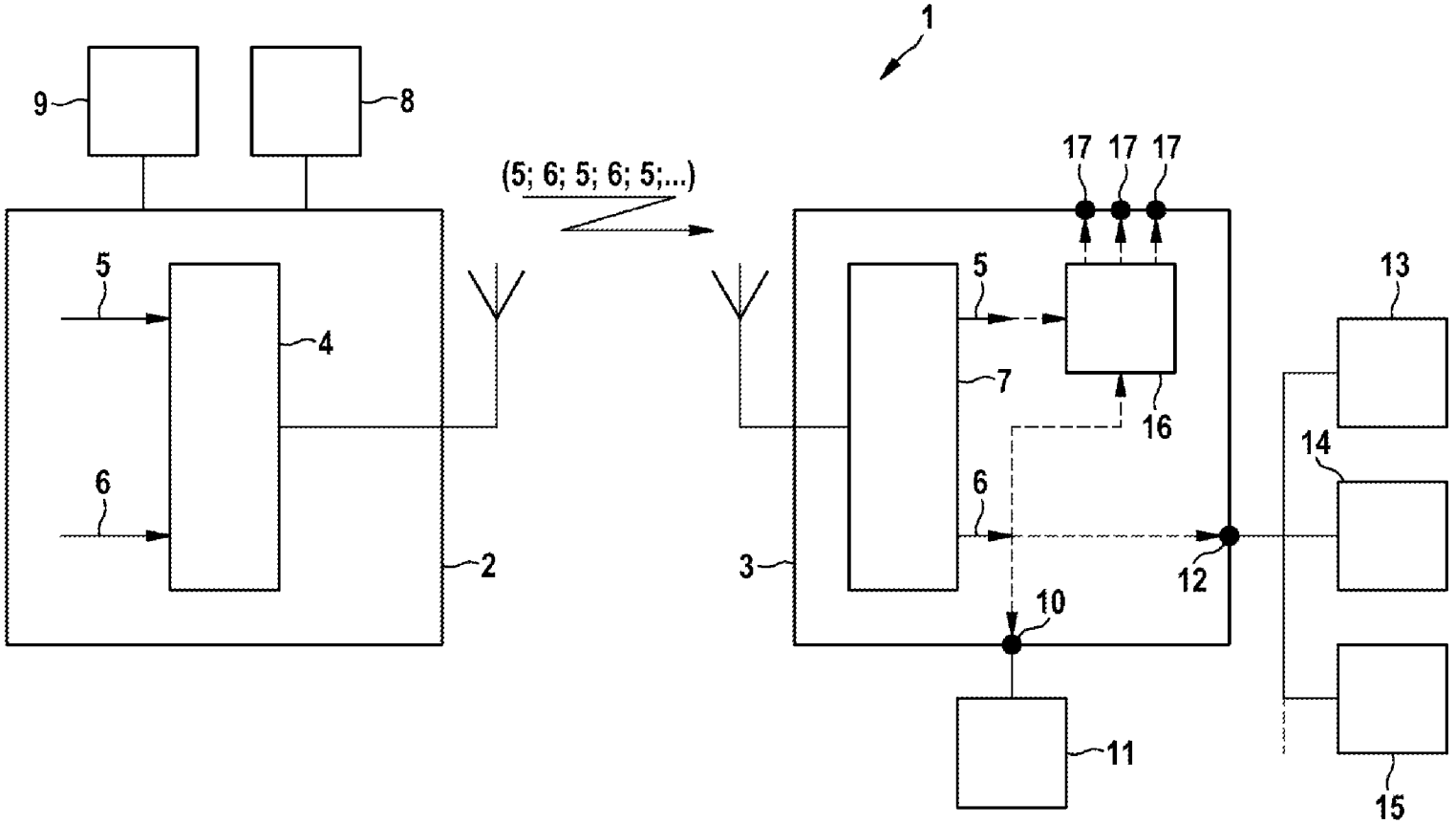
1
2
3
4
5
6
7
8
9
10
11
12
13
14
15
16
17
17
17
(5; 6; 5; 6; 5;...)

MICROPHONE SYSTEM

BACKGROUND

The invention relates to a microphone system comprising a microphone module and comprising a base station, wherein the microphone system is designed for transmitting audio information and additional information wirelessly from the microphone module to the base station.

Microphone systems for the wireless transmission of audio information are used in many cases, for example in concerts, talk shows, podium discussions etc. Such microphone systems usually comprise a portable microphone which comprises a transmitting unit which transmits the audio signals acquired by the microphone wirelessly as audio information to a base station. From there, the audio information or audio signals are forwarded to other audio devices such as, for example, recording devices, amplifiers, mixing consoles etc.

Apart from this basic functionality of transmitting audio information, it is known, for example from EP 1 174 840 A1, which probably forms the nearest prior art, to establish a bidirectional communication between the transmitting and receiving device via a further channel. For example, so-called Bluetooth modules from the field of mobile communication are proposed for implementing the separate channel.

SUMMARY

According to the invention, a microphone system is proposed which comprises at least one microphone module and at least one base station. In further embodiments of the invention, the microphone system can also comprise a plurality of such microphone modules and/or base stations which are in each case allocated to one another at least temporarily so that a multiplicity of microphone modules can be used in parallel.

The microphone module preferably has a microphone for picking up audio signals of a user or of an instrument etc. and a transmitting unit via which audio information which has been formed from the audio signals can be transmitted wirelessly. In particular, the audio information represents the digitized audio signals. The microphone module is preferably designed to be portable and can be implemented as a single component. Alternatively, the audio module consists of a number of components so that, for example, the microphone and the transmitting unit are spatially separate from one another and connected via a cable.

The base station is designed for receiving, and possibly decoding, the audio information of the microphone module, that is to say to reconvert the audio information into audio signals. However, this step can also be handled by a downstream component. It is preferably provided that precisely one base station is allocated to each microphone module. In the case of modified embodiments, it can also be provided that one base station is allocated to a number of microphone modules or that a microphone module is allocated to a number of base stations.

Apart from the audio information, additional information such as, for example, status information, control information and/or identification information can also be transmitted wirelessly from the microphone module to the base station.

Within the context of the invention, it is proposed that the microphone system, particularly the microphone module, especially the transmitting unit, is designed for transmitting the additional information and the audio information via a common channel and/or in a common data stream. In particular, a common channel is understood to be a common transmitting frequency which forms the carrier frequency for conveying the information, that is to say the additional information and the audio information. However, a digital channel can also be designed as the common channel. As an alternative or supplement, additional information or audio information is transmitted in a common data stream, particularly sequentially in the data stream.

The advantage of the invention can be seen particularly in that the system technology for establishing a second channel for transmitting additional information can be omitted. On the one hand, this represents a lowering of costs for the microphone system. On the other hand, the available transmitting frequencies are limited, in any case, in the microphone systems and must be achieved elaborately with in some cases more than 40 or 50 microphone module-base station allocations in the case of large performances so that the saving of additional channels can create additional space in the frequency spectrum.

In this context, it is particularly preferred that the transmission of the additional information and/or of the audio information is designed as a digital data transmission. When using a digital data transmission, a very high data rate can be achieved, so that, apart from the audio information in adequate quality, the additional information can also be transmitted in the same channel and/or data stream. For example, it can be provided that the additional information is arranged in a fixed area such as, for example, a header area.

One possible embodiment of the invention provides that the microphone module, especially the transmitting unit, has a multiplexer and the base station has a demultiplexer. The multiplexer is designed for integrating the audio information and the additional information in the common data stream whereas the demultiplexer is designed for extracting the additional information again from the common data stream. In particular, the multiplexer is designed for converting the parallel data streams of additional information and audio information into serial data streams. The demultiplexer forms the counterpart of the multiplexer by means of which the combined data channels are separated again.

In a development of the invention it is provided that the microphone module has an input unit and/or is coupled to the latter in order to input the additional information. In this context, it can be provided, for example, that the input unit is designed as buttons, switches, toggle switch, keypad, touch screen or as another HMI (Human Machine Interface). It is also possible that the microphone module is coupled wirelessly to such an input unit which is carried by the user at another location than the microphone module, e.g. as remote control.

In a development of the invention it is proposed that the base station has a communication interface to a communication device, wherein the additional information comprises control information for the communication device and the base station is designed for outputting the control information to the communication interface. In particular, the microphone system is optionally supplemented by the communication device, designed in such a manner that by means of the control information, previously specified information and/or messages and/or instructions are output. For example, it can be provided that, by operating the input unit, the user can inform other persons, for example its crew, of predefined information such as, for example, "monitor signal louder". It is particularly preferred that the additional information is designed as digital control information which triggers messages specified in the communication device or freely definable.

In another development of the invention it is proposed that the base station has a control interface for the amplifier system and/or peripheral devices, wherein the additional information comprises control information for the amplifier system and/or peripheral devices. In this embodiment, it is possible that the user, by operating the input unit, triggers control commands for example to the sound mixing console, the control console of the lighting system, to a control device for gyro effects etc. in order to there start, e.g., previously specified actions or change adjustments. Thus, for example, the user can switch on a special lighting effect at the precise time when he steps on the stage. A further application is that the user can adjust, and control, the adjustments of the amplifier system, especially of the monitor signal, that is to say an audio signal which is fed to him for his own orientation, more precisely or himself, respectively.

A nearest embodiment of the invention provides that the base station has a switching module, wherein the additional information comprises a switching information item and/or an address information item, wherein the base station is designed for forwarding the audio information according to the switching information and/or the address information to a switched one or to an address according to the address information. In the basic functionality, the audio information should be directed to the amplifier system so that they can be amplified and fed to a public. By means of the modification according to the invention it is possible, however, that the user, by input at the input unit selects another addressee for the audio signal or switches from a first addressee to a second, different addressee. Practical applications are, e.g., that the user temporarily does not transmit the audio information to the amplifier system but, for example, to auxiliary personnel in order to convey instructions. In other embodiments, different target groups such as sound technicians, directors or other artists can be addressed selectively with "in-ear-monitoring" by changing the addressing.

In an advantageous development it is proposed the additional information comprises a user ID information item which identifies the user of the microphone module. The user ID information can be input into the microphone module, for example manually, for example via the input unit, or via an automated procedure. The transmission of the user ID information can be utilized for verification that the identified user of the microphone module also obtains a user profile allocated to him. E.g., an amplifier channel is allocated to the user at the mixing console, which is intended for the user due to his role (main actor, main speaker, main instrument etc.). In a development of the invention, the base station comprises a user administration module or is coupled to it which keeps user profiles, wherein, on the basis of the user ID information, a user profile is selected and the parameters of the user profile selected are forwarded to the amplifier system and/or peripheral devices, in particular to the mixing console, and/or adjusted.

In an advantageous development of this invention, it is provided that the microphone module has an identification unit which is designed for identifying the user by means of an identification mark. For example, it is possible that the user carries an RFID mark and the microphone module is equipped with a corresponding receiver so that the user ID can be detected in an automated manner and transmitted as additional information. Via such an automated allocation, it is also possible that each user can take an arbitrary microphone module in a discussion, a performance or a concert and due to the transmission of the user ID information, the user profile and thus the user-specific adjustments are initiated for the further processing of the audio information. It is also possible that the users can freely exchange the microphones and, for example, can change from a first microphone which is allocated to a first base station to a second microphone which is allocated to a second base station, wherein the user profile is also changed in an automated manner.

BRIEF DESCRIPTION OF THE DRAWING

Further features, advantages and effects of the invention are obtained from the subsequent description of a preferred exemplary embodiment of the invention and the attached FIGURE, in which:

FIG. 1 shows a block diagram of a microphone system as an exemplary embodiment of the invention.

DETAILED DESCRIPTION

FIG. 1 shows in a highly schematic diagram a microphone system 1 which comprises a portable microphone module 2 and a base station 3 which provide for a wireless transmission of audio information 5 and additional information 6. The wireless transmission is preferably in a VHF/UHF transmitting range. The microphone module 2 has a microphone, not shown, and a transmitting unit. The microphone system 1 can optionally additionally also have further microphone module 2—base station 3 allocations; a base station 3 can be allocated a number of microphone modules 2 or a microphone module 2 is allocated a number of base stations 3.

The transmission of the audio information 5 and of the additional information 6 is carried out via a common serial data stream (5; 6; 5; 6, . . . ) in a multiplex mode. For this purpose, the microphone module 2 has a multiplexer 4 in which digital audio signals 5 are fed in as a first data stream and digital additional information 6 as a second data stream. These parallel data streams are converted into the serial data stream (5; 6; 5; 6, . . . ) by the multiplexer 4 and then transmitted wirelessly via the radio link. In contrast, the receiver has a demultiplexer 7 which converts a separation of the audio information 5 and of the additional information 6 into two separate data streams which then can be processed further.

The audio information 5 is usually digitized audio signals which are picked up by the microphone of the microphone module 2. The additional information 6 can be designed especially as control signal, information signals or user ID as will be illustrated by means of the figures in the text which follows.

To input the additional information, the microphone module can have an input unit 8 which, for example, is designed as switches, keys, buttons, keypad, touch screen etc. The additional information input via the input unit 8 is then mixed into the common data stream (5; 6; 5; 6, . . . ) and transmitted to the base station 3. An alternative embodiment provides that the microphone module 2 has an identification device 9 or is coupled to it which, by inputting an identification PIN via the input unit 8, via finger printing or an RFID mark worn on the body, detects a user ID of the user and mixes it as additional information into the common data stream (5; 6; 5; 6, . . . ). The microphone module 2 is thus designed to transfer both additional information input manually and additional information determined in an automated manner to the base station 3.

In a possible supplement to the microphone system, the base station 3 has a communication interface 10 which is coupled to a communication device 11. The communication device 11 is used for outputting previously defined information. For example, a control information item can be conveyed by the input unit 8, for example by pressing buttons, as additional information 6 via the microphone module 2, the base station 3 and the communication interface 10 to the communication device 11 so that a previously defined information item such as, for example, a "monitor signal quieter, louder etc." command is output there to other persons, in particular a crew.

In a further possible supplement, the base station 3 has a control interface 12 which is coupled to a mixing console 13, a control console of the lighting system 14, a control device 15 for gyro effects or other amplifier system components and/or peripheral devices. The user can transfer, by input in the operating unit 8, control signals as additional information 6 to the base station 3 and then via the control interface 12 to the units 13, 14 and 15 so that, for example, certain stored adjustments of the equipment can be called up and activated. Thus, for example, the user can switch on a special lighting effect at the precise time when he steps on the stage. This may not have been possible so precisely for the technician when the user was previously not visible.

Instead of or additionally to the operating unit, the microphone module can have a speech recognition device which is designed for recognizing, and transferring as additional information to the base station, spoken commands of the user. The speech recognition device could be activated by operating the input unit 8.

Another possible embodiment would be that the user can control the adjustment for his monitor signal, that is to say the audio signal which is fed to him for orientation, more precisely or via the operating unit 8, respectively, and the control interface 12.

In a further optional supplement, the base station 3 comprises a switching module 16 which can switch the audio signals and/or audio information to various outputs 17 and thus to various addressees. For example, the normal amplifier is allocated to a first output 17 so that the audio signal is output in an amplified manner. Another audio output 17 is switched, for example, to the crew so that the user can give voice instructions which are not intended to be heard by the listener. It is also possible that different target groups such as sound technicians, directors or other artists with in-ear monitoring are addressed selectively in that, by operating the operating unit 8, a control signal is transmitted as additional information 6 to the base station which signal drives the switching module and changes the output.

In a further optional supplement, the identification device 9 is designed so that the user can register or identify himself at the microphone module 2. This can be done, e.g. by inputting an identification (PIN) via the input unit 8 or also by finger printing or finger print recognition or an RFID worn on the body. The microphone module 2 transmits the user ID information as additional information 6. The base station 3 and/or a down-stream component such as, e.g. the mixing console, recognizes the microphone module 2 used from the additional information 6, and which user is currently using it, and can send his audio signal, e.g. via the switching module 16, to a certain address or to a certain channel at the mixing console or call up adjustments stored previously, e.g. in a user profile. For a sound technician, a particular artist can thus be controlled always via the same controller independently of which microphone module 2 he is currently using. This optional supplement takes into consideration that before a performance, the sound technician distributes/positions the microphone modules and marks on the mixing console which controller belongs to which microphone module 2. Thus, a mixing-console-controller—microphone module 2 allocation takes place. A direct mixing-console-controller—user allocation has hitherto not been possible. If the user exchanges the microphone module 2 or if he uses several microphone modules 2 at different locations on a large stage, the sound technician currently has to detect this change and respond to it. Thus, the mixing-console-controller is allocated to the user in a confusion-proof manner by the identification device 9.

The invention claimed is:

1. A microphone system (1) comprising a microphone module (2) and comprising a base station (3), wherein the microphone system (1) transmits audio information (5) and control information (6) wirelessly from the microphone module (2) to the base station (3), characterized in that the microphone module (2) transmits the control information (6) and the audio information (5) commonly; wherein the base station (3) outputs the control information to a device external to the base station, the control information based on an input to the microphone entered by a user for controlling the device external to the base station, and the microphone module (2) has a multiplexer (4) and the base station (3) has a demultiplexer (7), which are designed for combining, and separating, respectively, the audio information (5) and the control information (6) in a common data stream; the base station (3) having a switching module (16), wherein the control information (6) comprises an address and the base station (3) is designed for forwarding the audio information (5) to a device associated with the address.

2. The microphone system (1) as claimed in claim 1, characterized in that the transmission of the control information (6) takes place as a digital data transmission.

3. The microphone system (1) as claimed in claim 1, characterized in that the microphone module (2) has an input unit (8) and/or is coupled to the input unit (8) in order to input control information (6).

4. The microphone system (1) as claimed in claim 3, characterized in that the input unit (8) comprises buttons, switches, a keypad, a touch screen and/or toggle switches.

5. The microphone system (1) as claimed in claim 1, characterized in that the base station (3) has a communication interface (10) to a communication device (11), wherein the control information (6) comprises control information for the communication device (11) and the base station (3) is designed for outputting the control information to the communication interface (10).

6. The microphone system (1) as claimed in claim 1, characterized in that the base station (3) has a control interface (12), wherein the control information (6) comprises control information, and the base station (3) is designed for outputting the control information to the control interface (12).

7. The microphone system (1) as claimed in claim 1 or as claimed in the preamble of claim 1, characterized in that the control information (6) comprises a user ID information item which identifies the user of the microphone module (2).

8. The microphone system (1) as claimed in claim 7, characterized in that the base station (3) comprises an allocation module or is coupled to the allocation module which allocates to the user ID information a user profile with parameters for an amplifier system and/or peripheral devices (13, 14, 15).

9. The microphone system (1) as claimed in claim 7, characterized in that the microphone module (2) has an identification device (9) which is designed for identifying the user.

10. The microphone system (1) as claimed in claim 1, characterized in that the control information (6) and the audio information (5) are transmitted via a common channel.

11. The microphone system (1) as claimed in claim 1, characterized in that the control information (6) and the audio information (5) are transmitted in a common data stream.

12. The microphone system (1) as claimed in claim 1, characterized in that the control information (6) and the audio information (5) are transmitted via a common channel and in a common data stream.

13. The microphone system (1) as claimed in claim 6, characterized in that the control interface (12) and the control information are for an amplifier system.

14. The microphone system (1) as claimed in claim 6, characterized in that the control interface (12) and the control information are for peripheral devices (13, 14, 15).

15. The microphone system (1) as claimed in claim 6, characterized in that the control interface (12) and the control information are for an amplifier system and peripheral devices (13, 14, 15).

16. The microphone system (1) as claimed in claim 1, characterized in that the address is a switched address included in a switching information item included in the control information (6).

17. The microphone system (1) as claimed in claim 1, characterized in that the address is included in an address information item included in the control information (6).

18. The microphone system (1) as claimed in claim 16, characterized in that the an identification mark identifies the user.

19. A microphone system (1) comprising a microphone module (2) and comprising a base station (3), wherein the microphone system (1) transmits audio information (5) and control information (6) wirelessly from the microphone module (2) to the base station (3), characterized in that the microphone module (2) transmits the control information (6) and the audio information (5) commonly; wherein the base station (3) outputs the control information to a device external to the base station, the control information based on an input to the microphone entered by a user for controlling the device external to the base station, and the microphone module (2) has a multiplexer (4) and the base station (3) has a demultiplexer (7), which are designed for combining, and separating, respectively, the audio information (5) and the control information (6) in a common data stream; wherein the control information (6) comprises a user ID information item which identifies the user of the microphone module (2) and the base station (3) comprises an allocation module or is coupled to the allocation module which allocates to the user ID information a user profile with parameters for an amplifier system and/or peripheral devices (13, 14, 15).

* * * * *